United States Patent [19]

Yamamoto

[11] 4,426,922

[45] Jan. 24, 1984

[54] VERTICAL FRICTIONALLY ABRASIVE ROLL RICE POLISHING MACHINE

[76] Inventor: Soichi Yamamoto, 813 - 17 Oaza Tendou Kou, Tendou-Shi, Yamagata-Ken, Japan

[21] Appl. No.: 376,281

[22] Filed: May 10, 1982

[30] Foreign Application Priority Data

| | | | |
|---|---|---|---|
| Jun. 9, 1981 | [JP] | Japan | 56-96371 |
| Jun. 10, 1981 | [JP] | Japan | 56-89145 |
| Jun. 17, 1981 | [JP] | Japan | 56-93635 |
| Jun. 22, 1981 | [JP] | Japan | 56-96370 |

[51] Int. Cl.[3] ..... B02B 3/00; B02B 7/02

[52] U.S. Cl. ..... 99/519; 99/524; 99/528; 99/605; 99/610; 99/611; 99/618; 241/73; 241/239

[58] Field of Search ..... 99/518, 519, 523, 524, 99/568, 571, 574–576, 579, 580, 581, 582, 600–602, 605–608, 609–611, 617–622, 528; 241/244–246, 73, 239, 7; 130/27 M, 30 E

[56] References Cited

U.S. PATENT DOCUMENTS

| | | | |
|---|---|---|---|
| 655,805 | 8/1900 | Shellabarger | 241/246 |
| 3,960,068 | 6/1976 | Salete | 99/610 X |

FOREIGN PATENT DOCUMENTS

| | | | |
|---|---|---|---|
| 2640870 | 9/1975 | Fed. Rep. of Germany | 99/608 |

*Primary Examiner*—Timothy F. Simone

*Attorney, Agent, or Firm*—Shlesinger, Fitzsimmons & Shlesinger

[57] ABSTRACT

A vertical frictionally abrasive roll rice polishing machine in which a vertical rotary shaft extended in the vertically axial direction of a framework assembly, a vertical frictionally abrasive roll is mounted at the upper end of the shaft, a polishing cylinder surrounds the abrasive roll in coaxial and peripherally spaced relationship to the roll to define an annular polishing chamber therebetween, the polishing cylinder rotates and moves depending upon load applied thereto, the abrasive roll rotates but does not move vertically, a material supply passage is formed above the polishing chamber and a polished rice discharge passage is formed below the polishing chamber.

12 Claims, 22 Drawing Figures

VERTICAL FRICTIONALLY ABRASIVE ROLL RICE POLISHING MACHINE

BACKGROUND OF THE INVENTION

This invention relates to a vertical frictionally abrasive roll rice polishing machine, and more particularly, to a vertical frictionally abrasive roll rice polishing machine which makes it possible to polish hulled rice grains by grinding under load condition not feasible hithertofore.

As compared with a horizontal frictionally abrasive roll rice polishing machine, although a vertical grindingly abrasive roll rice polishing machine has the advantage that the generation rate of crushed rice grains is substantially lower than that of crushed rice grains in the horizontal frictionally abrasive roll rice polishing machine, since the vertical grindingly abrasive roll rice polishing machine is a rice polishing machine which polishes hulled rice grains under substantially no pressure, the polishing efficiency in the vertical grindingly abrasive roll rice polishing machine is substantially lower than that in the horizontal frictionally abrasive roll rice polishing machine.

The advantages and drawbacks inherent in the horizontal frictionally and vertical grindingly abrasive roll rice polishing machine will be in detail described hereinbelow. The rice polishing machine illustrated in FIG. 1 is a horizontal frictionally abrasive roll rice polishing machine and in the machine, a rice grain feed screw B and a frictionally abrasive roll C are coaxially mounted on a common horizontal shaft A. The shaft A, screw B and abrasive roll C are surrounded by coaxial horizontal polishing and feed cylinders D, D′ with one end of the shaft extending through one end wall of the feed cylinder D′. Hulled rice grains are supplied into the feed cylinder D′ at a supply port E formed in the top of the feed cylinder D′ adjacent the one end wall through which the one end of the shaft A extends and polished rice grains are discharged out of the feed cylinder D′ at a discharge port F formed in the other or opposite end wall of the feed cylinder D′. A resistance cover G is pivoted to the other end wall of the feed cylinder D′ right above the discharge port F. Although the horizontal frictionally abrasive rice polishing machine has the advantage that since the rice grains are frictionally polished under a high pressure provided by the resistance cover while being forcibly fed by the feed screw, the rice grains can be rapidly polished, the polishing machine inherently has the drawback that since the rice grains are polished by milling, a substantial amount of crushed rice grains are generated. In addition, in the horizontal frictionally abrasive roll rice polishing machine, since the polishing chamber is also a horizontal structure, some of the rice grains accumulate in a relatively thicker layer by their gravity in a lower portion of the polishing chamber and the rest are distributed in a relatively thinner layer in an upper portion of the polishing chamber resulting in uneven polishing. Nevertheless, due to the fact that a high polishing efficiency is attained and a relatively simple power transmission mechanism can be employed, the horizontal frictionally abrasive roll rice polishing machine is in most cases operated in rice polishing mill for general consumers' rice and the vertical grindingly abrasive roll rice polishing machine is scarcely operated in rice polishing mills for such rice.

FIG. 2 and 3 show two types of vertical grindingly abrasive roll rice polishing machines and in these Figures, reference character I denotes a vertical grindingly abrasive roll mounted on an upper portion of a vertical rotary shaft H for rotation therewith. When hulled rice grains a are supplied into the polishing chamber M at the supply port J above the polishing chamber, the rice grains are polished by the grindingly abrasive roll I (emery stone) rotating about its vertical axis while being stirred up by the roll in the horizontal and the polished rice grains are discharged out of the polishing chamber M via the discharge port K at the lower end of the chamber under centrifugal force produced by the rotating abrasive roll I. In this case, since the discharge port K is located on one side of the vertical axis of the polishing chamber M, the rice grains accumulating at the area shown by the arrow L on the opposite side of the axis of the polishing chamber M can not be easily discharged out of the chamber. Since the abrasive roll I is rotating about its vertical axis at a high speed as high as 2000 fpm in the horizontal, although the rice grains accumulating at the arrow L area may be driven away from the accumulating area by the rotating roll I and discharged out of the polishing chamber via the discharge port K under centrifugal force produced by the roll, when even only a small amount of rice grains a remain in the polishing chamber M or any slight increase occurs in the resisting force provided by the resistance cover G, the polishing chamber M is instantly clogged up with such rice grains resulting in the occurrence of trouble. That is, although the resistance cover G is provided, the cover is a pretended resistance device which offers substantially no resistance to the discharge of the rice grains and thus, the rice polishing machine is an inefficient device from the view point of rice polishing efficiency.

The prior art vertical grindingly abrasive roll rice polishing machine is a machine which can polish hulled rice grains by grinding under a certain load, but the machine is not perfectly satisfactory.

That is, in the rice polishing machine illustrated in FIG. 3, the lower end of the vertical rotary shaft H does not extend beyond the lower end of the abrasive roll I and instead, the upper end of the shaft H extends beyond the upper end of the abrasive roll I and a pulley N is mounted on the extended upper end of the shaft H and drivingly connected to an external drive source. The discharge passage K is provided at the bottom of the polishing chamber M right below the abrasive roll I different from the location of the discharge passage in the machine illustrated in FIG. 2. With the arrangement of the rice polishing machine of FIG. 3, the possibility of accumulation of rice grains at the area as shown by the arrow L is eliminated and thus, the resistance cover G can be provided below the discharge passage K to polish rice grains under grinding load. However, in the rice polishing machine of FIG. 3, the possibility of sudden clogging up of the polishing chamber with rice grains is not perfectly eliminated. And the vertical grindingly abrasive roll rice polishing machine of FIG. 3 has the drawback that hulled rice grains a have to be fed from the supply port J to the polishing chamber M through the clearances defined between the spokes on the pulley N. That is, since the pulley N rotates at a substantially high speed, the rice grains can not flow smoothly into the polishing chamber M and thus, an opening is provided in the top wall of the polishing chamber adjacent one side wall of the chamber eccentric to the vertical axis of the polishing chamber as shown by the arrow P. Such location of the supply port P is unsatisfactory because rice grains are fed to the polishing chamber sideways.

SUMMARY OF THE INVENTION

Therefore, the present invention is to provide a novel and improved vertical grindingly abrasive roll rice polishing machine which can effectively eliminate the drawbacks inherent in the prior art abrasive roll rice polishing machines referred to hereinabove.

The vertical grindingly abrasive roll rice polishing machine of the present invention is improved over the prior art abrasive roll rice polishing machines in that hulled rice grains are fed from right above the polishing chamber in the axial direction thereof and polished rice grains are discharged from right below the polishing chamber in the axial direction thereof.

The above and other objects and attendant advantages of the present invention will be more readily apparent to those skilled in the art from a reading of the following detailed description in conjunction with the accompanying drawings which show prior art rice polishing machines and preferred embodiments of the rice polishing machines constructed in accordance with the principle of the present invention for illustration purpose only, but not for limiting the scope of the invention thereto in any way.

PREFERRED EMBODIMENTS OF THE INVENTION

Figure 1:
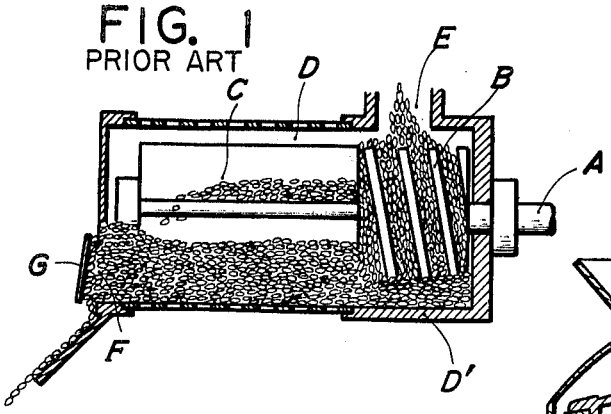
FIG. 1 PRIOR ART
FIG. 1 is a longitudinally sectional view of a prior art horizontal frictionally abrasive roll rice polishing machine.
Figure 2:
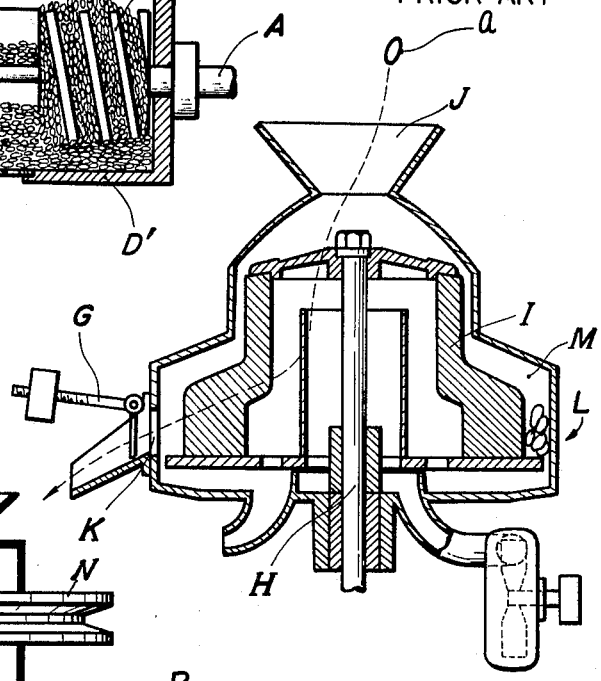
FIG. 2 PRIOR ART
FIG. 2 is a vertically sectional view of a prior art vertical grindingly abrasive roll rice polishing machine.
Figure 3:
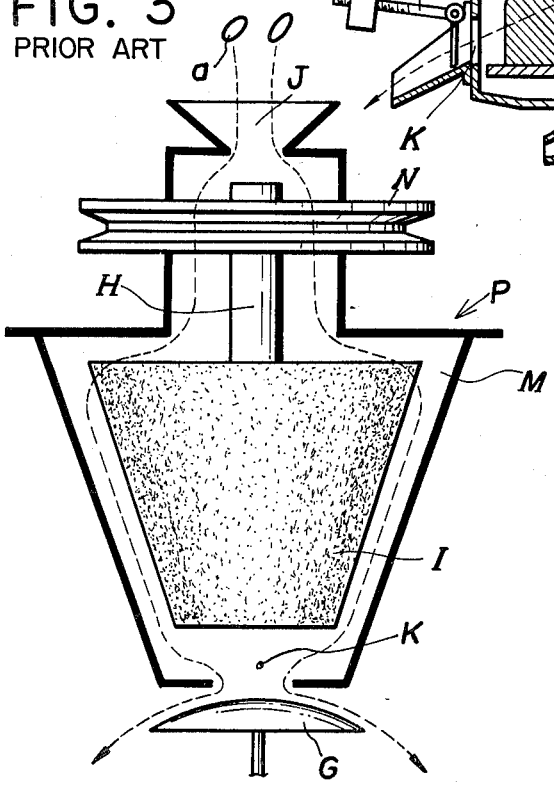
FIG. 3 PRIOR ART
FIG. 3 is a vertically sectional view of another prior art vertical grindingly abrasive roll rice polishing machine.
Figure 4:
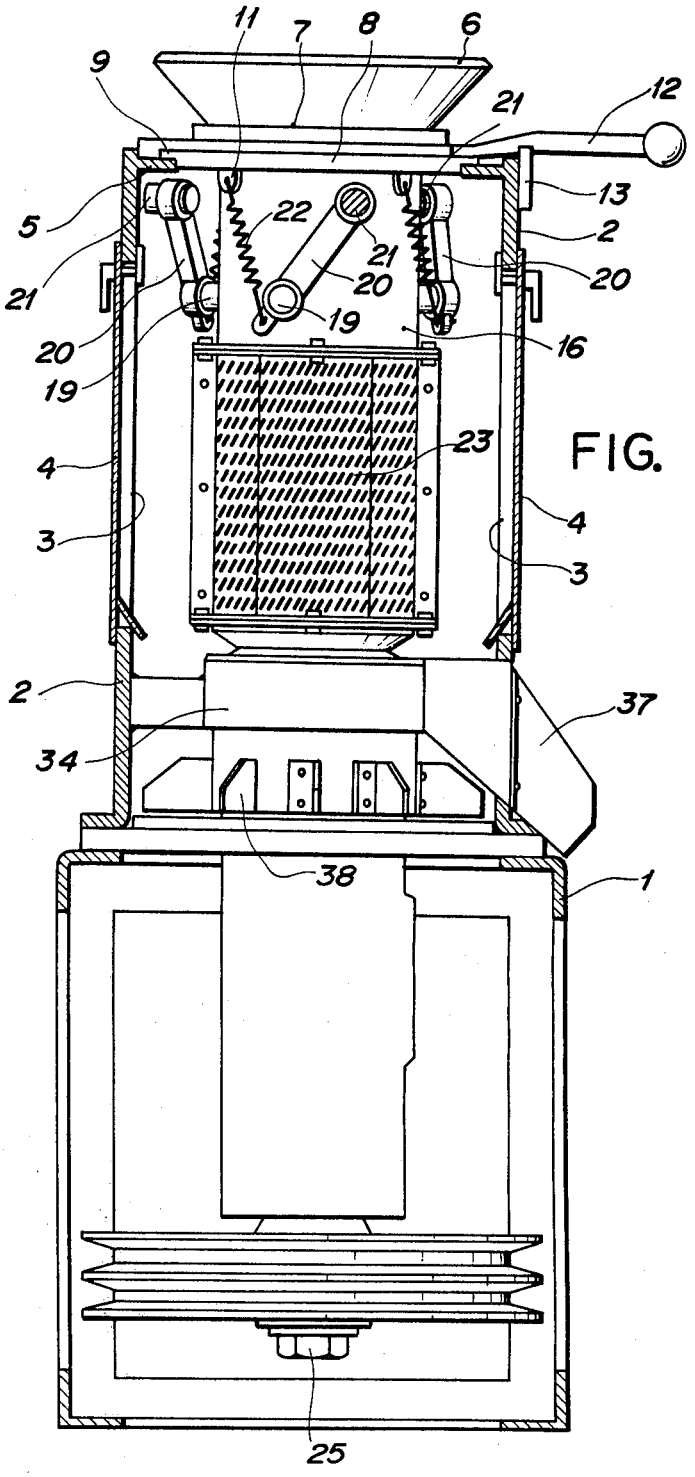
FIG. 4 is an elevational view in partial section of a first embodiment of the vertical frictionally abrasive roll rice polishing machine constructed in accordance with the principle of the present invention.
Figure 5:
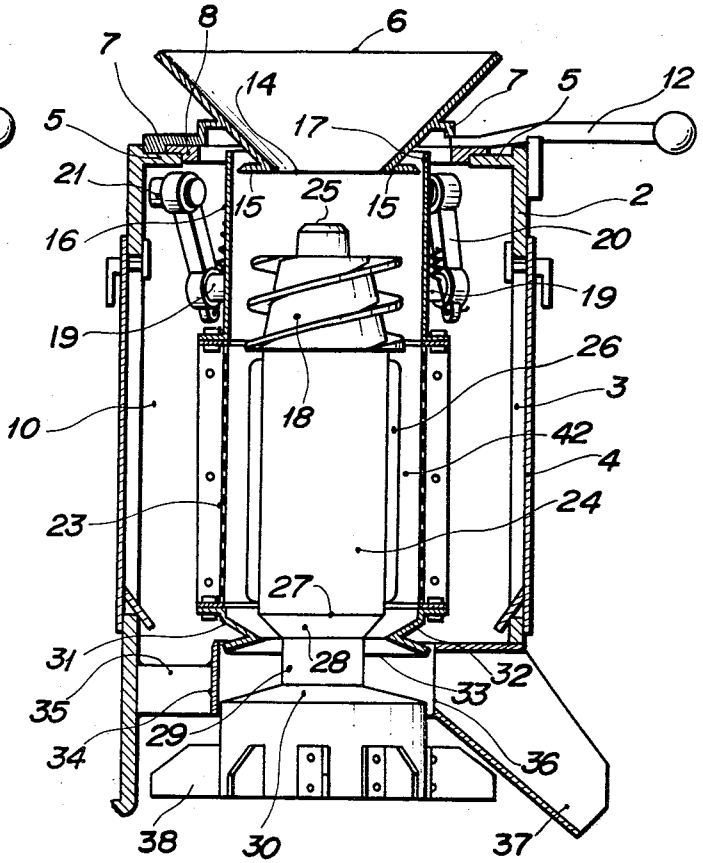
FIG. 5 is a vertically sectional view of the upper half portion of said polishing machine as shown in FIG. 4.
Figure 6:
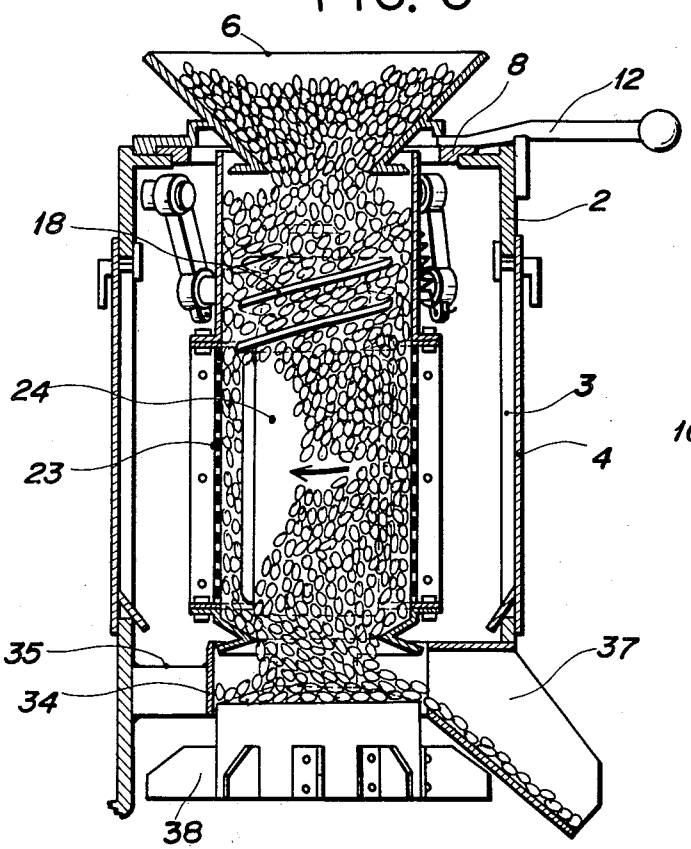
FIG. 6 is similar to FIG. 5, but shows the rice polishing operation being carried out in the machine.
Figure 7:
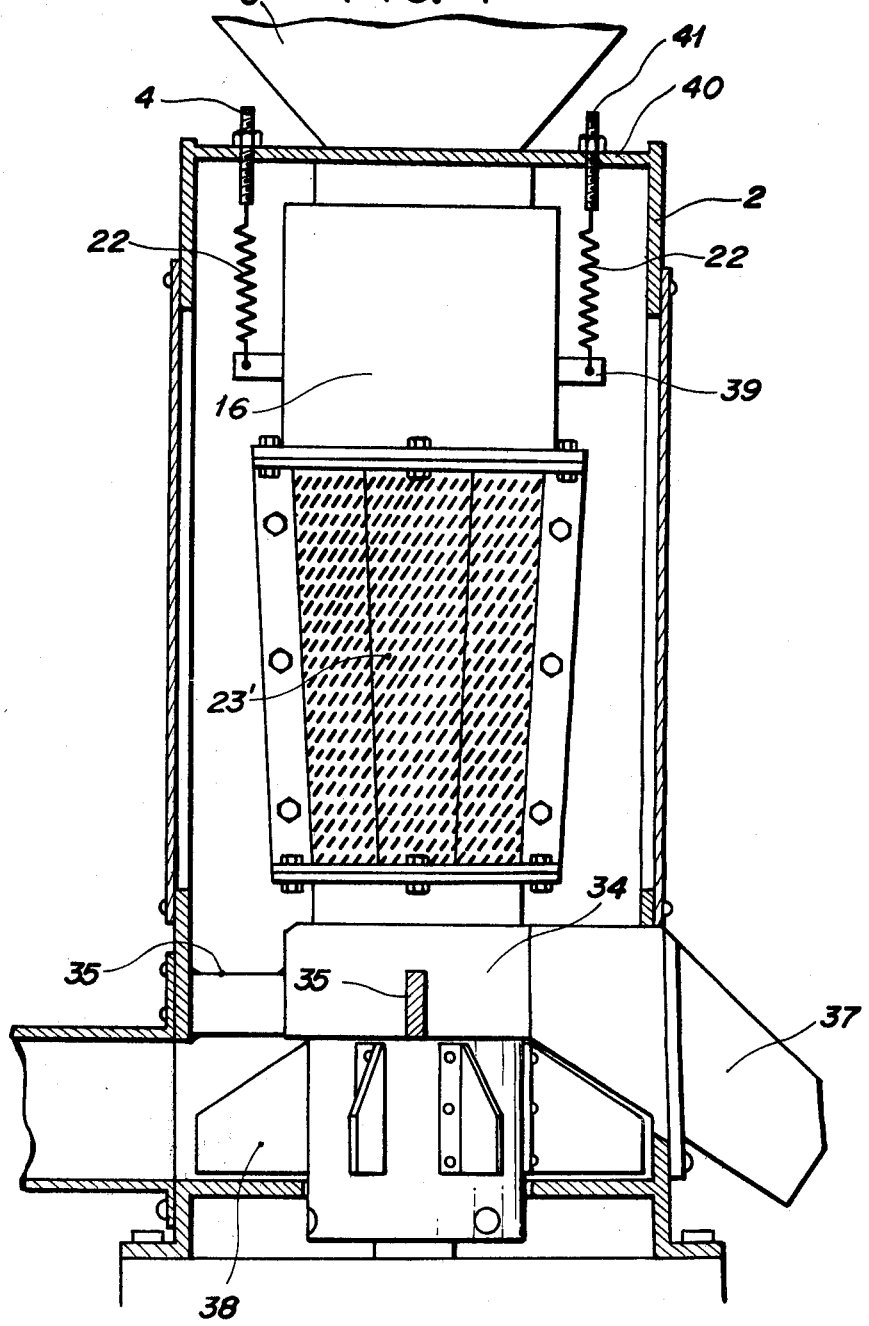
FIG. 7 is an elevational view in partial section of the upper half portion of a second embodiment of the vertical frictionally abrasive roll rice polishing machine constructed in accordance with the principle of the present invention in which a modified polishing cylinder hanging mechanism is employed.
Figure 8:
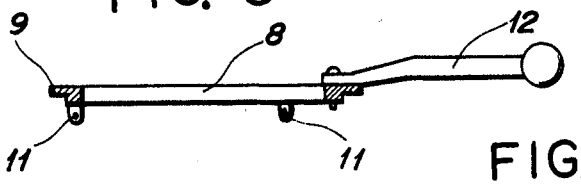
FIG. 8 is a view in partial section of the spring bearing ring in the vertical frictionally abrasive roll rice polishing machine of the invention.
Figure 9:
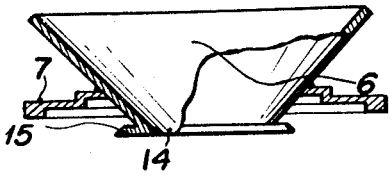
FIG. 9 is a vertically sectional view of the material supply hopper in the vertical frictionally abrasive roll rice polishing machine of the invention.
Figure 10:
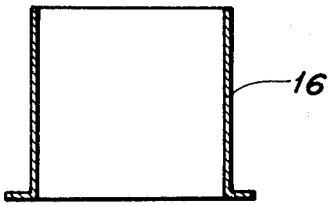
FIG. 10 is a vertically sectional view of the vertically movable cylinder in the vertical frictionally abrasive roll rice polishing machine of the invention.
Figure 14:
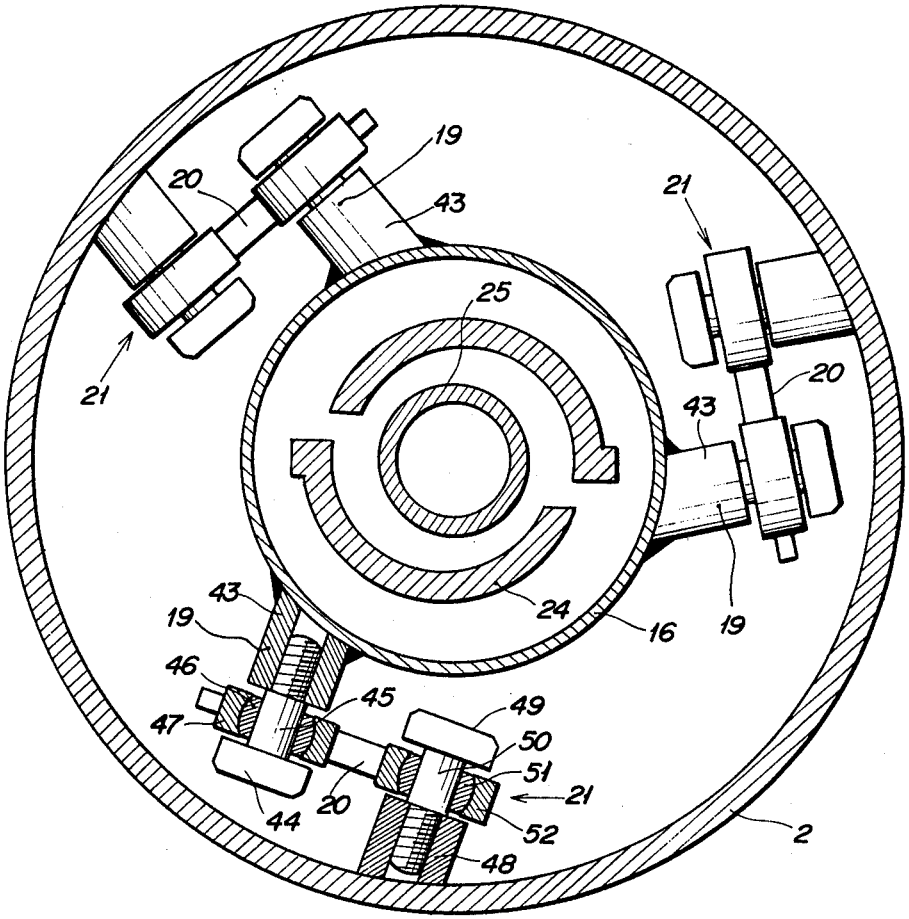
FIG. 14 is a cross-sectional view of the vertically movable cylinder.
Figure 17:
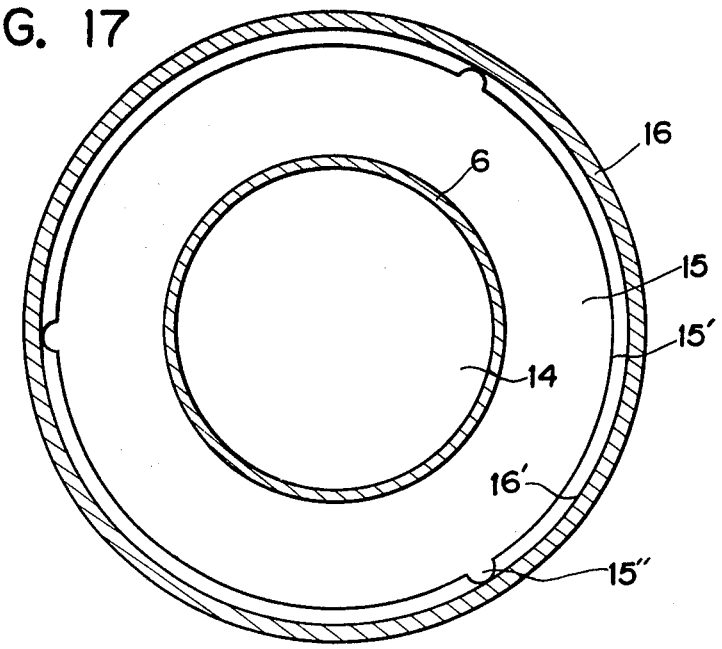
FIG. 17 is a plan view in cross-section of a lower portion of the hopper.
Figure 18:
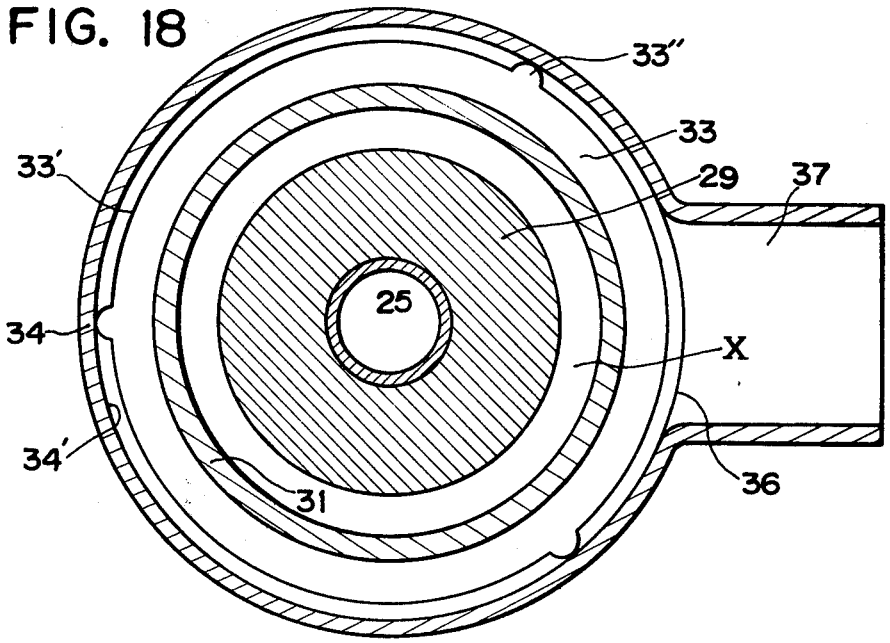
FIG. 18 is a plan view in cross-section of the discharge passage.
Figure 19:
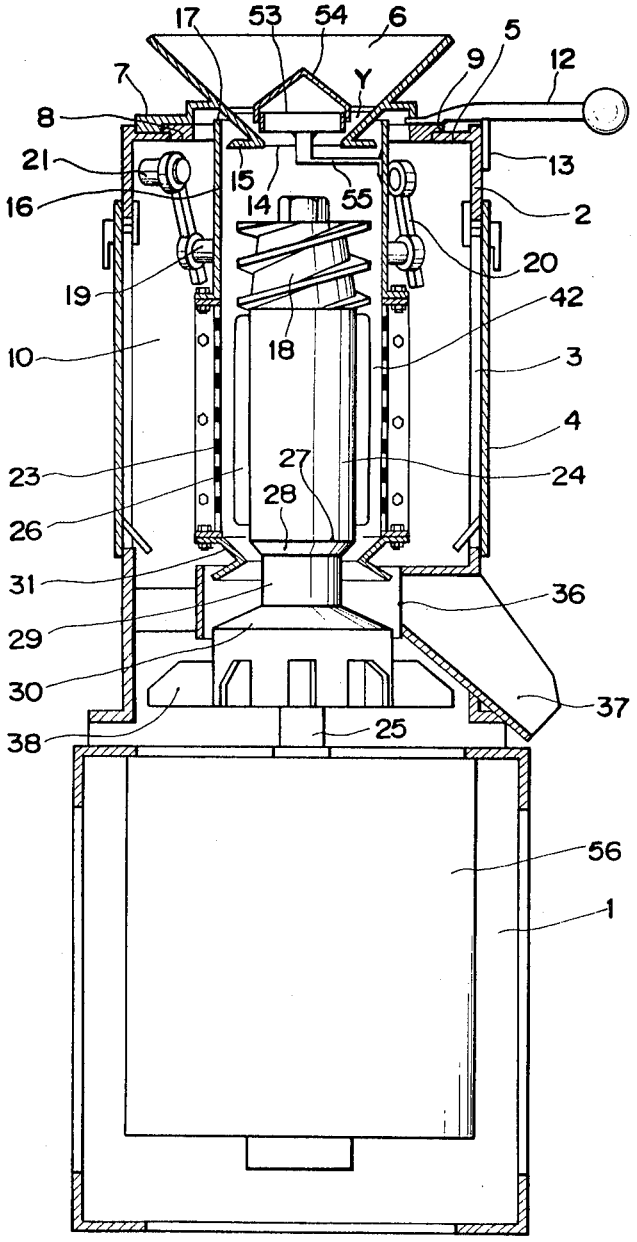
FIG. 19 is a vertically sectional view of a fifth embodiment of the vertical frictionally abrasive roll rice polishing machine constructed in accordance with the principle of the present invention in which the supply passage is adjustable.
Figure 20:
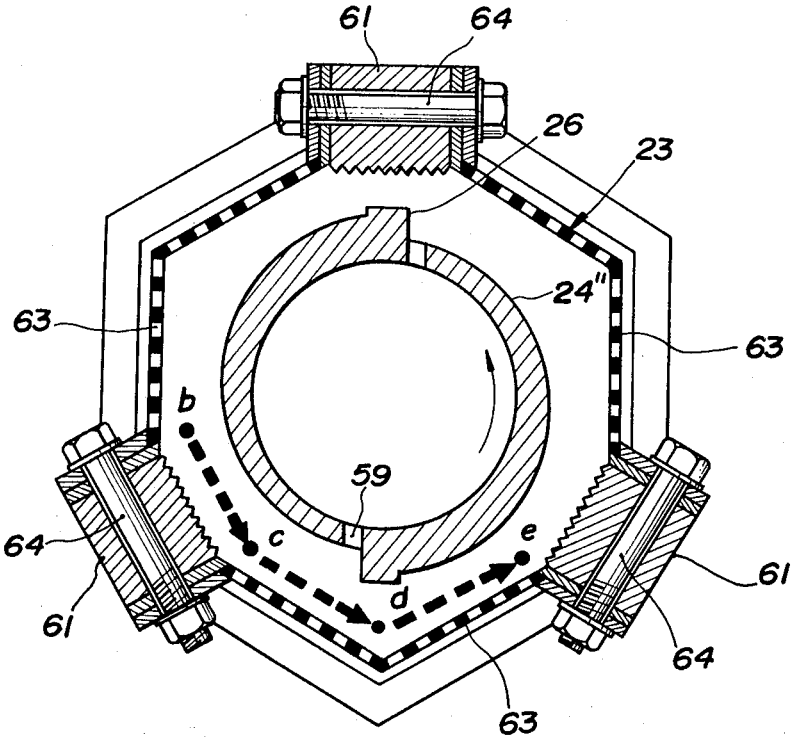
FIG. 20 is a plan view in cross-section of a sixth embodiment of the vertical frictionally roll rice polishing machine constructed in accordance with the principle of the present invention in which a modified polishing cylinder is employed.
Figure 21:
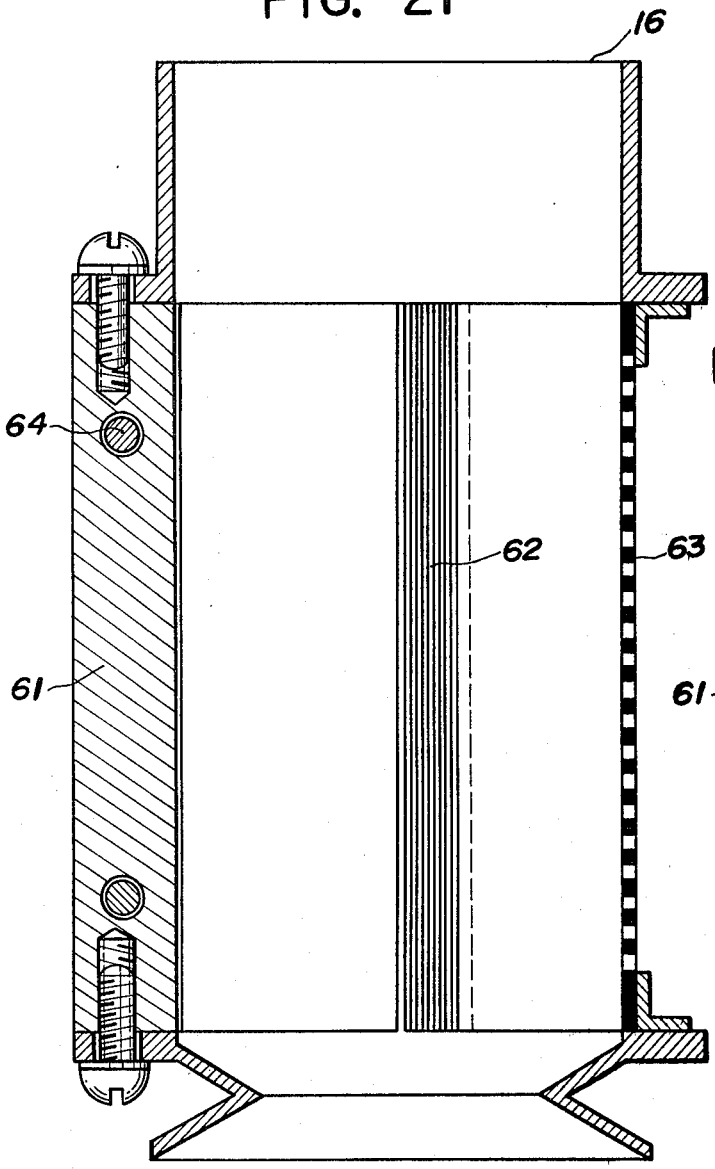
FIG. 21 is a vertically sectional view of the lower half portion of the polishing machine as shown in FIG. 20.
Figure 22:
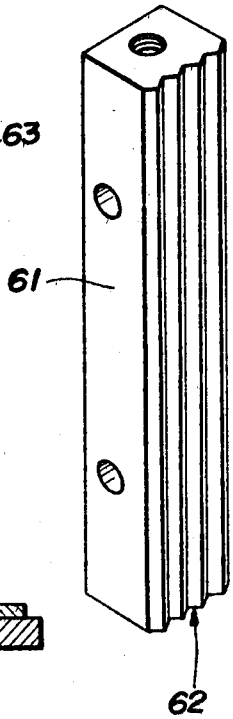
FIG. 22 is a perspective view of the support pillar as shown in FIG. 20.

The present invention will be now described referring to FIGS. 4 through 22 in which embodiments of the vertical frictionally abrasive roll rice polishing machine of the invention are illustrated. Reference numeral 1 denotes a lower framework on and to which an upper framework 2 is mounted and suitably secured. The upper framework 2 is in the form of a vertical hollow cylinder which has a circular or square cross-section as seen in the horizon. The peripheral side wall of the framework 2 is provided with a plurality of spaced window openings 3 which are adapted to be opened and closed by covers 4 detachably attached to the peripheral side wall of the framework 2. The upper end or top of the upper framework 2 is provided with a stepped annular flange 5 extending inwardly towards the vertical axis of the framework and the mount 7 of a hopper 6 is mounted on the upper surface of the shoulder on the flange 5 (see FIG. 9). In addition to the hopper 6, the flange 5 has a spring bearing ring 8 attached thereto (see FIG. 8). The peripheral edge 9 of the spring bearing ring 8 rides on the shoulder of the flange 5 and the rest of the ring is positioned within the hollow interior 10 of the upper framework 2. Attached to the undersurface of the spring bearing ring 8 are spring receiving projections or ears 11. Reference numeral 12 denotes a manual lever secured to the spring bearing ring 8 and by rotating the lever 12 in a horizontal plane, the spring bearing ring 8 is rotated in a horizontal plane. Reference numeral 13 denotes a stop adapted to engage the lever 12 when the lever has rotated to a predetermined position in its rotational movement to arrest the rotational movement of the lever. The lower end of the supply port 14 in the hopper 6 is defined by an annular ring 15 lying in a horizontal plane. As more clearly shown in FIG. 17, the annular ring 15 has a truly circular shape as seen in the horizontal and includes at the outer periphery 15' a plurality of equally spaced short projections 15'' (three projections in the illustrated embodiment) extending radially outwardly therefrom. Reference numeral 16 denotes a vertically slidable cylinder (or rice grain feed cylinder) having the upper end 17 which surrounds the entire periphery of the annular ring 15. The height of the cylinder 16 is so selected that even when the cylinder is in its predetermined lower-most position the upper end 17 does not lie in a horizontal plane below the horizontal plane of the ring 15. The vertically movable cylinder 16 is of truly circular shape as seen in the horizontal and has a uniform diameter throughout the height. Suitably provided within the interior of the cylinder 16 is a rice grain feed screw 18. As more clearly shown in FIG. 14, the vertically movable cylinder has at the outer periphery thereof three first bearing means 19 extending radially outwardly in equally spaced relationship and inclined rods 20 are journalled at their lower ends on the outer ends of the bearing means 19 whereas the upper ends of the rods are journaled at the inner ends of second bearing means 21 secured to and extending radially inwardly from the inner surface of the upper framework 2. The rods 20 are in the form of a universal joint. Each of the first bearing means comprises an internally threaded sleeve 43 secured to and extends radially outwardly from the outer periphery of the cylinder 16, a bolt 44 having the shank 45 including a threaded portion in threaded engagement with the internal threads on the sleeve 43 and a smooth portion positioned out of the sleeve, a spherical member 46 having a center through opening through which the shank smooth portion extends and a journal box 47 provided at the lower end of the associated rod 20 and slidably receiving the spherical member 46. Similarly, each of the second bearing means 21 comprises an internally threaded sleeve 48 secured to and extending radially inwardly from the inner surface of the upper framework 2, a bolt 49 having the shank including a threaded portion in threaded engagement with the internal threads on the sleeve and a smooth portion positioned out of the sleeve, a spherical member 51 having a center through opening through which the shank smooth portion extends and a journal box 52 provided at the upper end of the associated rod 20 and slidably receiving the spherical member 51. Springs 22 extend between and are anchored at the opposite ends to the extreme lower ends of the rods 20 and to the ears 11 on the spring bearing ring 8 (see FIG. 4). When the above-mentioned manual lever 12 is rotated in a horizontal plane to rotate the spring bearing ring 8 in the direction to extend the springs 22 (the clockwise 30 direction as seen in FIG. 4), the tension on the springs 22 is increased. The arrangement allows the vertically movable cylinder 16 to move upwardly and downwardly as the cylinder 16 rotates because the cylinder 16 is hung from the inclined rods 20 and springs 22. However, in the embodiment illustrated in FIG. 7, since the vertically movable cylinder 16 is hung by only the springs 22, the cylinder 16 merely moves vertically. In FIG. 7, reference numeral 39 denotes a pair of spring receiving ears extending radially outwardly from the opposite sides of the peripheral side wall of the cylinder 16, reference numeral 40 denotes the top wall of the upper framework 2 and reference numeral 41 denotes adjusting screws 41 extending through threaded holes in the top wall 40 for adjusting the height of the cylinder 16. In this embodiment, the springs 22 extend between and are anchored at the upper and lower ends to the adjusting screws 41 and ears 32, respectively. FIG. 19 shows an embodiment in which a regulator valve 53 is suitably mounted within the hopper 6 for varying the opening of the material supply passage Y in the hopper. The regulator valve 53 is vertically movable within a hollow conical member 54 fixedly secured to the interior of the hopper 6 and the valve is operatively connected to the inner surface of the movable cylinder 16 by means of a L-shaped link 55. Thus, when the cylinder 16 moves downwardly against the force of the springs 22, the regulator valve 53 follows the downward movement of the cylinder 16 to thereby contract the opening of the supply passage Y. Connected to the lower end of the vertically movable cylinder 16 is a polishing cylinder 23. In this embodiment, the polishing cylinder 23 serves as a bran removal cylinder and is formed of a plurality of perforated stamped plates so as to have a hexagonal cross-section as seen in the horizontal. The polishing cylinder 23 as shown in FIGS. 20 through 22 is formed of three perforated stamped plates 63 and three support pillars and thus, has an enneagon cross-section as seen in the horizontal. In these Figures, reference numeral 61 denotes a square vertical support pillar having saw teeth 62 extending along the entire height of the inwardly facing face thereof. Three pillars 61 are erected in equal angularly spaced relationship in a horizontal plane and triangularly bent perforated plates 63 are applied to the pillars bridging between the adjacent pillars and secured thereto by means of bolts 64. Suitably mounted within the thus formed enneagon cross-section polishing cylinder 23 is a frictionally abrasive roll 24. In the embodiment illustrated in FIG. 19, the abrasive roll 24 is directly connected to a motor to be driven thereby. The feed screw 18 and abrasive roll 24 are mounted at the upper end of the output shaft 25 of a motor 56 mounted on the lower framework 1. The abrasive roll 24 has vertical projections 26 extending radially outwardly from the periphery thereof in the diametrically opposite directions and the projections may be inclined in the direction to float up rice grains being polished within the polishing chamber 42. In the embodiment illustrated in FIG. 15, the abrasive roll 24' is the shape of an inverted frustoconical roll which reduces its diameter towards the lower end and the polishing cylinder 23' also has an inverted frustoconical shape in conformity with the shape of the roll 24'. In the embodiment illustrated in FIG. 16, the abrasive roll 24'' is similar to the roll in FIG. 15, but is a substantially hollow roll having an axial opening through which a rotary shaft in the form of a pipe 58 having a number of through holes 60 extends. The abrasive roll 24'' itself has a number of air jets 59 in the peripheral side wall thereof for spouting air therethrough. Reference numeral 57 denotes an air suction port. A downwardly tapered portion 28 extends from the lower end 27 of the abrasive roll 24 and a reduced diameter vertical cylinder 29 is connected at the upper end thereof to the lower end of the tapered portion 28. Connected to the lower end of the reduced diameter cylinder 29 is the upper end of a tapered guide face means 30 which increases its diameter towards the lower end thereof. The upper end of a resistance member 31 is attached to the lower end of the above-mentioned polishing cylinder 23 (see FIG. 11). The resistance member 31 is in the form of a ring and has at the lower end the diameter corresponding to that of the lower end of the polishing cylinder 23. The upper half portion of the resistance member 31 forms a tapered resistance face 32 reducing its diameter towards the lower half portion of the member which increases its diameter towards the lower end of the resistance member to provide an enlarged diameter portion 33. The tapered portion 28 and tapered resistance face 32 define a discharge passage X therebetween (see FIG. 18). The vertically movable cylinder 16, polishing cylinder 23 and resistance member 31 form a unitary structure for rotation and vertical movement in unison. The vertical cylinder 29 is surround by a guide cylinder 34 in peripherally spaced relationship thereto. The upper end of the resistance member 31 surrounds the enlarged portion 33 at the lower end of the resistance member 31. FIG. 18 is a sectional plan view of the arrangement of the enlarged portion 33, resistance member 31 and their associated parts at their lower ends. As shown in this Figure, the outer periphery 33' of the enlarged portion 33 includes three equally spaced projections 33" extening radially outwardly for engaging the inner periphery 34' of the guide cylinder 34. Even when the enlarged portion 33 is in its predetermined uppermost position, the enlarged portion 33 will not slip off the guide cylinder 34. The guide cylinder 34 is secured to the upper framework 2 by means of a plurality of connector members 35. A portion of the guide cylinder 34 is cut away to provide a discharge port 36 the outer end of which is connected to a discharge chute 37. The hollow interior 10 of the upper framework 2 serves as a bran receiving chamber for receiving the bran blown from the polishing cylinder 23. In order to remove the bran from the bran receiving chamber, a bran suction fan 38 is provided below the tapered guide face means 30.

In operation, an external motor (not shown) or the motor 56 directly connected to the abrasive roll 24 is energized to rotate the abrasive roll 24 and rice grain feed screw 18 and hulled rice grains a are supplied from the hopper 6 into the polishing chamber 42 whereupon the rice grains flow downwardly by their gravity within the polishing chamber 42.

Figure 11:
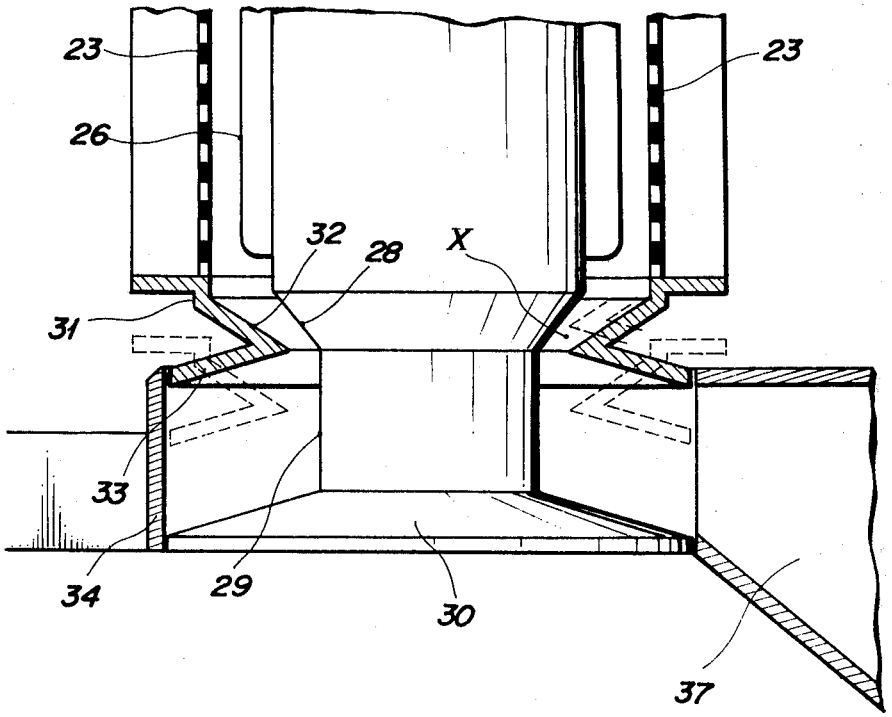
FIG. 11 is a fragmentary vertically sectional view showing the discharge passage in the vertical frictionally abrasive roll rice polishing machine of the invention.
Figure 12:
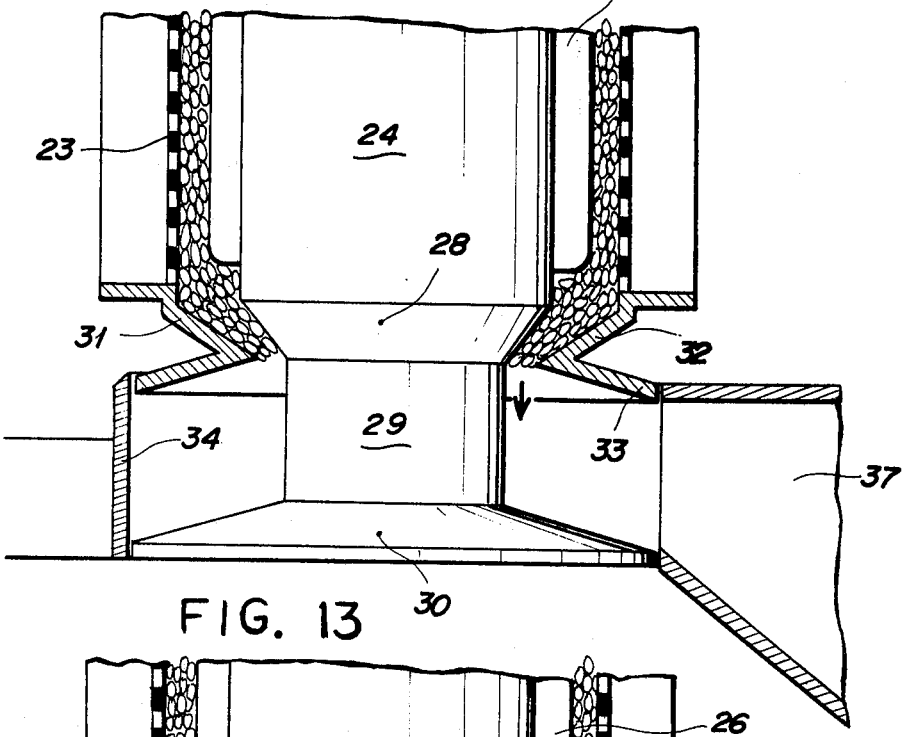
FIG. 12 is similar to FIG. 11, but shows the discharge passage in its contracted condition.
Figure 13:
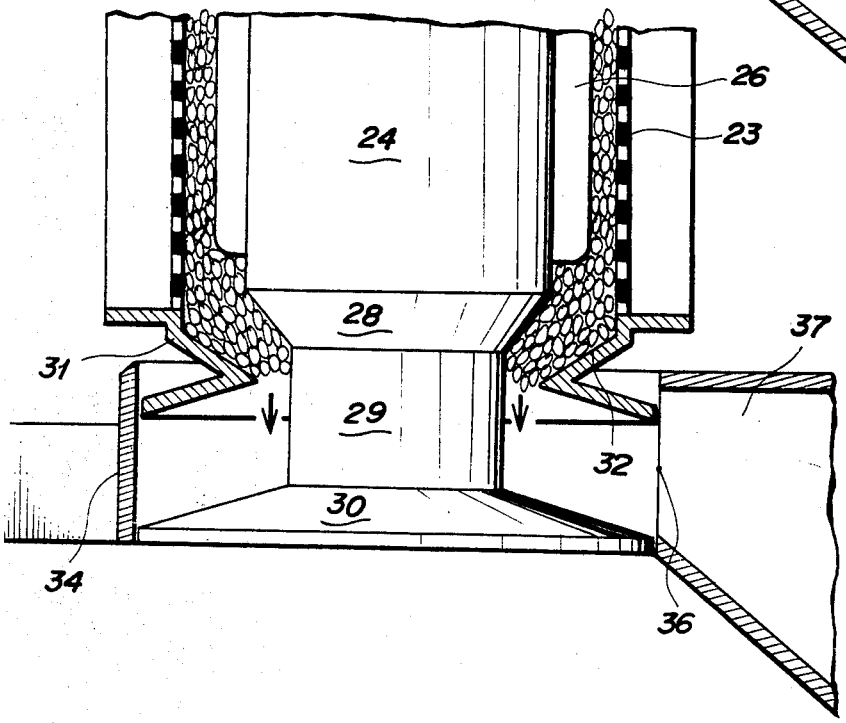
FIG. 13 is similar to FIG. 11, but shows the discharge passage in its expanded condition.
Figure 15:
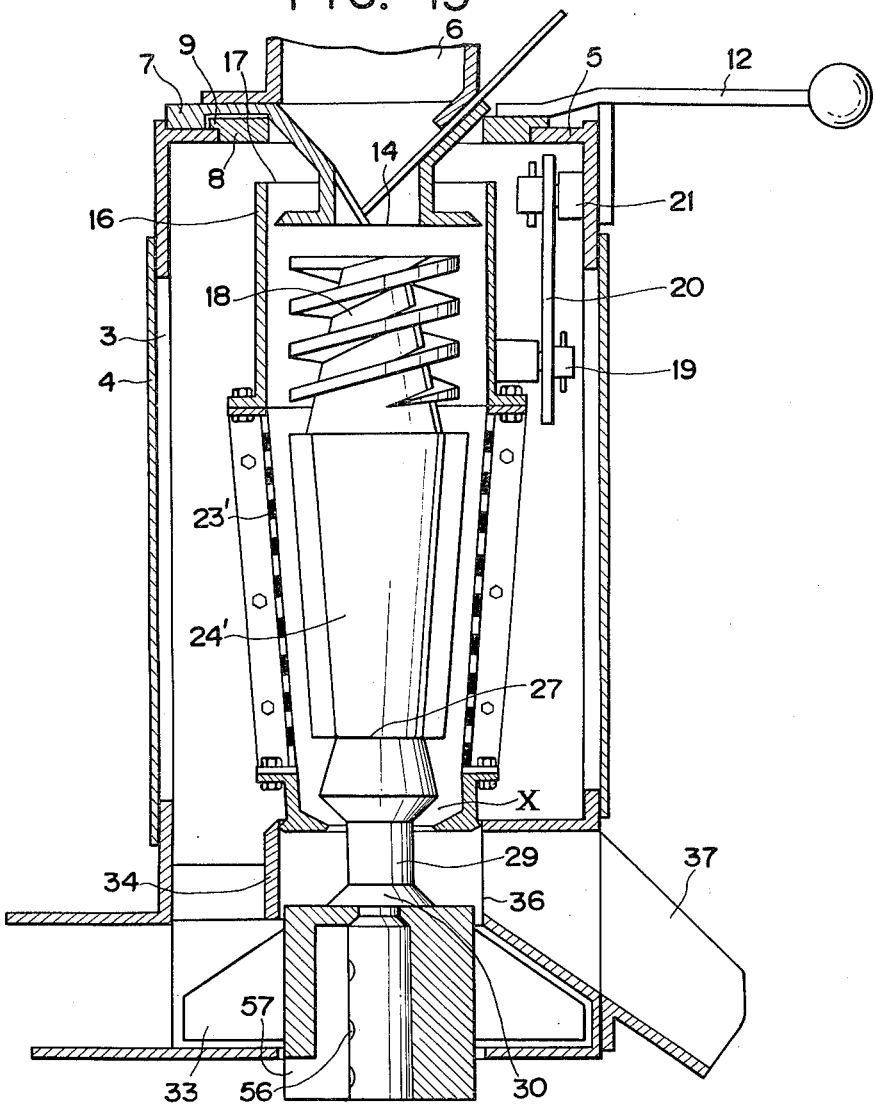
FIG. 15 is a vertically sectional view of the upper half portion of a third embodiment of the vertical frictionally abrasive roll rice polishing machine constructed in accordance with the principle of the present invention in which a modified frictionally abrasive roll is employed.
Figure 16:
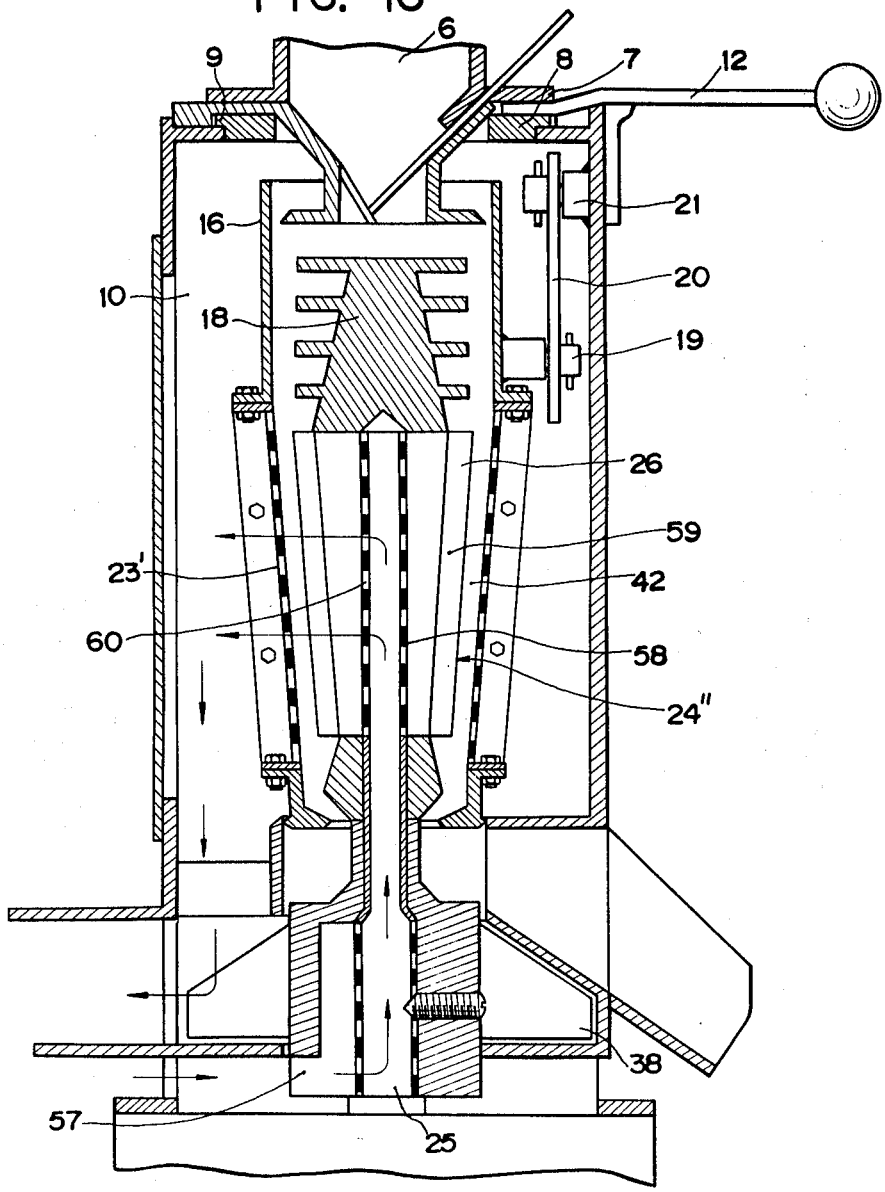
FIG. 16 is a vertically sectional view of the upper half portion of a fourth embodiment of the vertical frictionally abrasive roll rice polishing machine constructed in accordance with the principle of the present invention in which a bast roll is employed.

Immediately after the initiation of the operation of the polishing machine, since the polishing chamber 42 is empty, the abrasive roll 24 rotates rapidly whereby the vertically movable cylinder 16, polishing cylinder 23 and resistance member 31 are pulled upwardly to their uppermost position by the three springs 22 to thereby contract the opening of the discharge passage X to its predetermined smallest value as shown by the solid line in FIG. 11. Thus, since the amount of polished rice grains to be discharged through the discharge passage X is greater than that of hulled rice grains supplied from the hopper 6, the polishing chamber 42 is fed with the hulled rice grains in increment whereby the rotating abrasive roll 24 having the projections 26 polishes the hulled rice grains into polished rice grains which then fall down onto the discharge passage X by their gravity (see FIG. 6). At this time, in the embodiment or embodiments as shown in FIG. 7 or FIGS. 15 and 16, since the abrasive roll 24 reduces its diameter towards the lower end 27, the lower end 27 of the abrasive roll 24 rotates at a slower rate than that at which the rest of the roll does to produce an upward component of force to push the rice grains a upwardly to thereby cause the clogging up of the discharge passage X with the rice grains. And in the embodiment illustrated in FIG. 16, air sucked at the suction port 57 is spouted through the through holes in the pipe 58 and the air jets 59 in the abrasive roll 24" into the polishing chamber 42 and thus, the bran separated from the polished rice grains by the projections 26 is blown into the bran removal cavity 10 to obtain completely polished rice grains.

In the embodiments other than the embodiment illustrated in FIG. 7, the polishing cylinder 23 rotates about the vertical axis thereof in a horizontal plane in accordance with load applied thereto. As the abrasive roll 24 rotates in the rice polishing operation, the polishing cylinder 23 rotates about its vertical axis against the restraining force of the springs 22 and simultaneously moves downwardly due to the inclined rods 20 to thereby increase the volume of the polishing chamber 42 and allow the resistance member 31 to move downwardly to the dotted line position in FIG. 11 whereby the cross-sectional area of the discharge passage X is increased to allow the rice grains a to smoothly flow down along the passage X resulting in prevention of the clogging up of the passage with the rice grains (FIG. 23) and automatic reduction of load applied to the polishing chamber 42 for prevention of the generation of crushed rice grains. By adjusting the tension on the springs 22 through the operation of the lever 42, the yield of polished rice grains can be optionally adjusted. That is, when hulled rice grains a are of the type which are brittle, the tension on the springs 22 is reduced and on the other hand, when the rice grains are of the type which are not brittle, the tension on the springs 22 is increased. In FIGS. 17 and 18, since the projections 15" and 33" make point contact with the inner surfaces 16', 34' of the vertically movable and guide cylinders 16, 34, respectively, the vertically movable cylinder 16, polishing cylinder 23 and resistance member 31 can rotate smoothly. In the embodiments illustrated in FIG. 20 and the ensuing Figures, friction rice polishing and grinding rice polishing are alternately performed to enhance the polishing efficiency. That is, as the frictionally abrasive roll 24 rotates in the arrow direction, or counterclockwise in FIG. 20, the saw teeth 62 on the inner surface of the pillars 61 polish the rice grains a as the projections 26 are moving the rice grains a from Point b to Point c (see FIG. 20) and the rice grains a rub each other while they are being moved from Point c to Point e by the projections 26. The grinding and rubbing are alternately repeated.

With the above-mentioned construction and arrangement of the components of the rice polishing machine and the operation of the machine of the invention, variation in the opening of the discharge passage X depending upon variation in load applied to the polishing chamber, rice polishing can be attained while reducing the generation of crushed rice grains.

It will be understood that various changes in the details, materials and arrangements of parts which have described and illustrated in order to explain the nature of the invention, may be made by those skilled in the art within the principle and scope of the invention.

What is claimed is:

1. A vertical frictionally abrasive roll rice polishing machine comprising a framework assembly including upper and lower frameworks, a vertical rotary shaft having an upper end extending within said upper framework in the axial direction of said framework assembly, a vertical abrasive roll mounted adjacent the upper end of said shaft for rotation therewith, a vertical polishing cylinder surrounding said abrasive roll in peripherally spaced relationship to the roll to define an annular polishing chamber therebetween, means for forcibly feeding unhulled rice into the upper end of said polishing chamber for travel downwardly in the axial direction of the chamber to a discharge passage provided at the lower end of said polishing chamber, and means mounting said polishing cylinder for limited vertical movement relative to said abrasive roll.

2. The vertical frictionally abrasive roll rice polishing machine as set forth in claim 1, in which said polishing chamber is vertically adjustable in length depending upon the quantity of rice forced into the upper end of the chamber, and said abrasive roll is rotatable about its vertical axis, but is immovable vertically.

3. The vertical frictionally abrasive roll rice polishing machine as set forth in claim 1, in which the volume of said discharge passage is variable as said polishing cylinder moves vertically.

4. The vertical frictionally abrasive roll rice polishing machine as set forth in claim 1, in which the volume of said discharge passage is increased and reduced as said polishing cylinder moves upwardly and downwardly, respectively.

5. The vertical frictionally abrasive roll rice polishing machine as set forth in claim 1, in which said polishing cylinder rotates as it moves upwardly and downwardly.

6. The vertical frictionally abrasive roll rice polishing machine as set forth in claim 1, in which said polishing cylinder is suspended from the top of said upper framework by means of a spring and inclined rod assembly.

7. The vertical frictionally abrasive roll rice polising machine as set forth in claim 1, in which said frictionally abrasive roll is formed adjacent its lower end with a downwardly tapered portion which reduces in diameter downwardly, and said polishing cylinder is formed adjacent its lower end with an upwardly tapered resistance face which increases the diameter downwardly, and which confronts upon said downwardly tapered portion of the abrasive roll to define said discharge passage therebetween.

8. The vertical frictionally abrasive roll rice polishing machine as set forth in claim 7, in which said discharge passage defined by said tapered portion of the abrasive roll and said confronting tapered resistance face of the polishing cylinder reduces in thickness towards the lower end thereof.

9. The vertical frictionally abrasive roll rice polishing machine as set forth in claim 1, in which said frictionally abrasive roll has an inverted frusto-conical shape and said polishing cylinder also has an inverted frusto-conical shape.

10. The vertical frictionally abrasive roll rice polishing machine as set forth in claim 1, in which said frictionally abrasive roll is directly connected to a motor to be directly driven thereby.

11. The vertically frictionally abrasive roll rice polishing machine as set forth in claim 1, in which said vertical rotary shaft is in the form of a pipe having a plurality of through holes in its side wall, said abrasive roll is in the form of a hollow roll having a plurality of holes in its side wall, and means is provided for causing air to flow from said pipe successively through its holes and the holes in said roll.

12. The vertically frictionally abrasive roll rice polishing machine as set forth in claim 1, in which said polishing cylinder includes alternate polishing and grinding portions.

* * * * *